US007990064B2

(12) United States Patent
Ohmura et al.

(10) Patent No.: US 7,990,064 B2
(45) Date of Patent: Aug. 2, 2011

(54) PHOTOMULTIPLIER

(75) Inventors: Takayuki Ohmura, Hamamatsu (JP); Teruhiko Yamaguchi, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 900 days.

(21) Appl. No.: 11/594,234

(22) Filed: Nov. 8, 2006

(65) Prior Publication Data

US 2008/0088232 A1 Apr. 17, 2008

Related U.S. Application Data

(60) Provisional application No. 60/851,751, filed on Oct. 16, 2006.

(51) Int. Cl.
*H01J 43/20* (2006.01)

(52) U.S. Cl. ..... 313/535; 313/532; 313/533; 313/534; 313/536

(58) Field of Classification Search ..... 313/532–536
See application file for complete search history.

(56) References Cited

U.S. PATENT DOCUMENTS

| | | | | |
|---|---|---|---|---|
| 2,945,144 | A * | 7/1960 | Hahn et al. | 313/533 |
| 3,849,644 | A | 11/1974 | Ibaugh | |
| 4,415,832 | A | 11/1983 | Faulkner et al. | |
| 4,456,852 | A | 6/1984 | Faulkner et al. | |
| 4,881,008 | A | 11/1989 | Kyushima et al. | |
| 5,077,504 | A | 12/1991 | Helvy | |
| 5,124,551 | A | 6/1992 | Urakami et al. | |
| 5,416,382 | A | 5/1995 | L'Hermite | |
| 5,438,191 | A | 8/1995 | Kimura et al. | |
| 5,532,551 | A | 7/1996 | Kyushima et al. | |
| 5,578,891 | A | 11/1996 | Sakai et al. | |
| 5,581,158 | A | 12/1996 | Quazi | |
| 5,598,060 | A | 1/1997 | L'Hermite | |
| 5,689,152 | A * | 11/1997 | Boutot et al. | 313/532 |
| 5,864,207 | A | 1/1999 | Kume et al. | |
| 5,917,282 | A | 6/1999 | Suyama et al. | |
| 5,936,348 | A * | 8/1999 | Shimoi et al. | 313/533 |

(Continued)

FOREIGN PATENT DOCUMENTS

DE 869834 3/1953

(Continued)

OTHER PUBLICATIONS

Hidehiro Kume et al., "Photomultiplier Tubes For $BaF_2$/BGO Crystal Scintillators", IEEE Transaction on Nuclear Science, Feb. 1986, pp. 364-369, vol. 33, No. 1.

(Continued)

*Primary Examiner* — Nimeshkumar D Patel
*Assistant Examiner* — Thomas A Hollweg
(74) *Attorney, Agent, or Firm* — Drinker Biddle & Reath LLP

(57) ABSTRACT

The present invention relates to a photomultiplier that realizes significant improvement of response time properties with a structure enabling mass production. In the sealed container, a photocathode, a dynode unit including at least one dynode set, and preferably dynode sets of two series, a focusing electrode unit arranged between the photocathode and the dynode unit are housed. The focusing electrode unit is set to the same potential as the second dynode arranged at a position where secondary electrons from said first dynode, which emits secondary electrons in response to incidence of photoelectrons, arrive, and is provided with partitioning plates partitioning the second dynode into two in a longitudinal direction of the second dynode.

2 Claims, 9 Drawing Sheets

U.S. PATENT DOCUMENTS

| | | | |
|---|---|---|---|
| 6,927,538 | B2 | 8/2005 | Ishizu et al. |
| 7,064,485 | B2 | 6/2006 | Kimura et al. |
| 7,115,854 | B1 | 10/2006 | Kato et al. |
| 2003/0146697 | A1 | 8/2003 | Ishizu et al. |
| 2004/0251417 | A1 | 12/2004 | Yamaguchi et al. |
| 2005/0212421 | A1 | 9/2005 | Kimura et al. |
| 2008/0088234 | A1 | 4/2008 | Ohmura et al. |

FOREIGN PATENT DOCUMENTS

| | | |
|---|---|---|
| JP | 57-194445 | 11/1982 |
| JP | 59-108254 | 6/1984 |
| WO | WO 2005/013311 | 2/2005 |
| WO | 2005/091332 | 9/2005 |
| WO | 2005/091333 | 9/2005 |

OTHER PUBLICATIONS

T. Yamashita et al., "New Dual Rectangular Photomultiplier Tube For Positron Ct." IEEE Catalog No. 82CH1751-7, International Workshop on Physics and Engineering in Medical Imaging, Mar. 15-18, 1982, pp. 209-211, Pacific Grove, California.

* cited by examiner

PHOTOMULTIPLIER

CROSS-REFERENCE TO RELATED APPLICATION

This application claims priority to U.S. Provisional Application Ser. No. 60/851,751 filed on Oct. 16, 2006 by the same Applicant, which is hereby incorporated by reference in its entirety.

BACKGROUND OF THE INVENTION

1. Field of the Invention

The present invention relates to a photomultiplier, which, in response to incidence of photoelectrons, can perform cascade multiplication of secondary electrons by successive emission of the secondary electrons in multiple stages.

2. Related Background Art

In recent years, development of TOF-PET (Time-of-Flight PET) as a next-generation PET (Positron Emission Tomography) device is being pursued actively in the field of nuclear medicine. In a TOF-PET device, because two gamma rays, emitted from a radioactive isotope administered into a body, are measured simultaneously, a large number of photomultipliers with excellent, high-speed response properties are used as measuring devices that are disposed so as to surround an object.

In particular, in order to realize high-speed response properties of higher stability, multichannel photomultipliers, in which a plurality of electron multiplier channels are prepared and electron multiplications are performed in parallel at the plurality of electron multiplier channels, are coming to be applied to next-generation PETs, such as that mentioned above, in an increasing number of cases. For example, a multichannel photomultiplier described in International Patent Publication No. WO2005/091332 has a structure, in which a single faceplate is partitioned into a plurality of light incidence regions (each being a photocathode to which a single electron multiplier channel is allocated) and a plurality of electron multiplier sections (each arranged from a dynode unit, made up of a plurality of stages of dynodes, and an anode), prepared as electron multiplier channels that are allocated to the plurality of light incidence regions, are sealed inside a single glass tube. A photomultiplier with the structure, such that a plurality of photomultipliers are contained inside a single glass tube, is generally called a multichannel photomultiplier.

As described above, a multichannel photomultiplier thus has a structure such that a function of a single-channel photomultiplier, with which photoelectrons emitted from a photocathode disposed on a faceplate are electron multiplied by a single-electron multiplier section to obtain an anode output, is shared by the plurality of electron multiplier channels. For example, in a multichannel photomultiplier, with which four light incidence regions (photocathodes for electron multiplier channels) are two-dimensionally arranged, because for one electron multiplier channel, a photoelectron emission region (effective region of the corresponding photocathode) is made ¼ or less of the faceplate, electron transit time differences among the respective electron multiplier channels can be improved readily. Consequently, as compared with the electron transit time differences within the entirety of a single channel photomultiplier, a significant improvement in electron transit time differences can be anticipated with the entirety of a multichannel photomultiplier.

SUMMARY OF THE INVENTION

The present inventors have examined the above conventional multichannel photomultiplier, and as a result, have discovered the following problems. That is, in the conventional multichannel photomultiplier, because electron multiplications are performed by electron multiplier channels that are allocated in accordance with release positions of photoelectrons from the photocathode, the positions of the respective electrodes are designed optimally so as to reduce electron transit time differences according to each electron multiplier channel. In this manner, by such improvement of the electron transit time differences in each electron multiplier channel, improvements are made in the electron transit time differences of the whole multichannel photomultiplier and consequently, the high-speed response properties of the whole multichannel photomultiplier are improved.

However, in such a multichannel photomultiplier, no improvements had been made in regard to the spread of the average electron transit time differences among the electron multiplier channels. Also, in regard to a light emission surface (surface positioned in the interior of the sealed container) of the faceplate on which the photocathode is formed, the shape of the light emission surface is distorted in a peripheral region that surrounds a central region, which includes the tube axis of the sealed container, and especially at boundary portions (edges of the light emission surface) at which the light emission surface and an inner wall of the tube body intersect. The equipotential lines between the photocathode and the dynodes or between the photocathode and the focusing electrode are thereby distorted, and even within a single channel, photoelectrons that fall astray may be generated depending on the photoelectron emission position. The presence of such stray photoelectrons cannot be ignored for further improvement of high-response properties.

Furthermore, because a large number of photomultipliers are required for the manufacture of a TOF-PET device, employment of a structure that is more suited for mass production is desired with photomultipliers that are applied to a TOF-PET device, etc.

The present invention has been developed to eliminate the problems described above, and an object thereof is to realize reduction of crosstalk between electron multiplier channels by a structure more suited for mass production to provide a photomultiplier that is significantly improved as a whole in such response time properties as TTS (Transit Time Spread) and CTTD (Cathode Transit Time Difference).

Presently, PET devices added with a TOF (Time-of-Flight) function are developed. In photomultipliers used in such a TOF-PET device, the CRT (Coincidence Resolving Time) response properties are also important. Conventional photomultipliers do not meet the CRT response properties requirements of TOF-PET devices. Thus, in the present invention, because a conventional PET device is used as a basis, a currently used bulb outer diameter is maintained, and trajectory design is carried out to enable CRT measurements that meet the requirements of a TOF-PET device. Specifically, improvement of the TTS, which is correlated with the CRT response properties, is aimed at, and trajectory design is carried out to improve both the TTS across an entire faceplate and the TTS in respective incidence regions.

A photomultiplier according to the present invention comprises a sealed container that is provided, at a bottom portion thereof, with a pipe for reducing the pressure of the interior of the container to a predetermined degree of vacuum, and a photocathode and an electron multiplier section that are provided inside the sealed container. The sealed container is constituted by a faceplate, a tube body (bulb), having the faceplate fusion-joined to one end and extending along a predetermined tube axis, and a stem fusion-joined to the other end of the tube body and constituting a bottom portion of the sealed container. The faceplate has a light incidence surface and a light emission surface that opposes the light incidence surface, and the photocathode is formed on the light emission surface positioned at the inner side of the sealed container. The sealed container may have an envelope portion, with which the faceplate and the tube body are formed integrally, and in this case, the sealed container is obtained by fusion-joining the stem to an opening of the envelope portion.

An installation position of the electron multiplier section in the tube axis direction inside the sealed container is defined by lead pins that extend into the sealed container from the stem. The electron multiplier section also includes a focusing electrode unit, for modifying trajectories of photoelectrons emitted into the sealed container from the photocathode, and a dynode unit, for cascade multiplication of the photoelectrons.

In the photomultiplier according to the present invention, the dynode unit has a pair of insulating supporting members that hold the focusing electrode unit and clampingly hold at least one set of electrodes that cascade-multiply the photoelectrons from the photocathode. In particular, in a case where two or more electrode sets are held by the pair of insulating supporting members, these electrode sets are positioned across the tube axis. One or more electron multiplier channels may be formed by each electrode set, and an anode is prepared according to each electron multiplier channel that is formed.

In particular, the photomultiplier according to the present invention has, as a structural feature, a partitioning plate for partitioning the second dynode into two in a longitudinal direction of the second dynode. The second dynode is set to a higher potential than the first dynode, which emits secondary electrons according to the incidence of photoelectrons from the photocathode, and is arranged at a position at which the secondary electrons from the first dynode arrive. By the partitioning plate arranged inside the second dynode, crosstalk between mutually adjacent electron multiplier channels formed from one dynode set can be reduced effectively. That is, the trajectories of electrons that propagate successively along the plurality of stages of dynodes are significantly reduced in the possibility of crossing across to adjacent electron multiplier channels in this process (the crosstalk between adjacent electron multiplier channels is reduced significantly).

Preferably, the partitioning plate is a metal tab of the focusing electrode unit that is arranged between the photocathode and the dynode unit and is set to the same potential as the second dynode. In this case, the metal tab of the focusing electrode unit extends in a direction directed from the photocathode to the dynodes.

As a structure for disposing at least a part of the metal tab of the focusing electrode unit inside the second dynode, the second dynode preferably has a slit that puts a front surface, on which a secondary electron emitting surface is formed, in communication with a back surface that opposes the front surface. By a tip of the metal tab of the focusing electrode unit inserted into a space between the first dynode and the second dynode via the slit of the second dynode, two electron multiplier channels can be formed in one dynode set.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, embodiments of a photomultiplier according to the present invention will be explained in detail with reference to FIGS. 1, 2A-2B, 3-4, 5A-5B, 6, and 7A-9C. In the explanation of the drawings, constituents identical to each other will be referred to with numerals identical to each other without repeating their overlapping descriptions.

Figure 1:
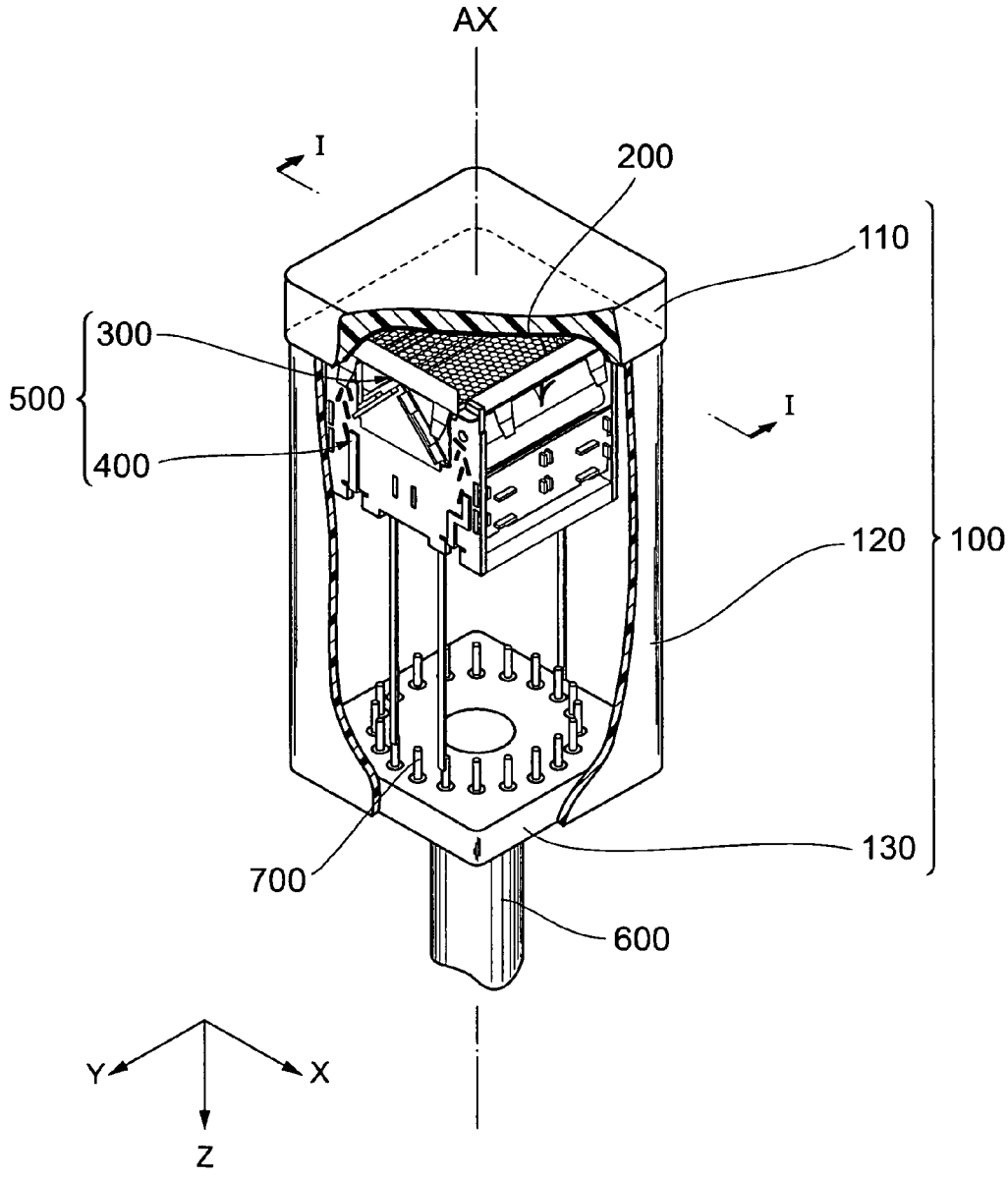
FIG. 1 is a partially broken-away view of a general configuration of an embodiment of a photomultiplier according to the present invention.
Figure 2A:
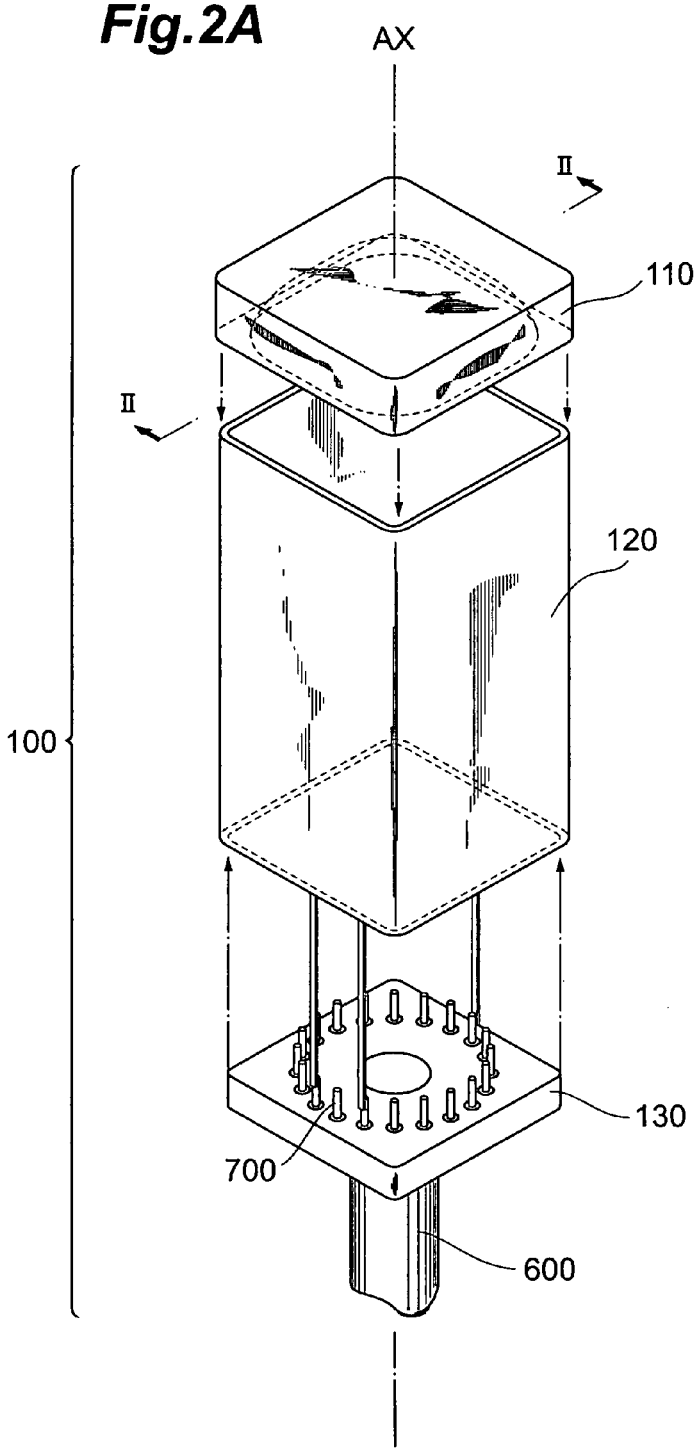
FIGS. 2A and 2B are an assembly process diagram and a cross sectional view, respectively, for explaining a structure of a sealed container in the photomultiplier according to the present invention.
Figure 2B:
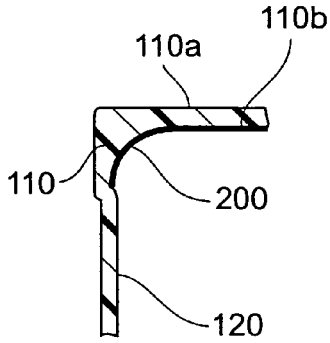

FIG. 1 is a partially broken-away view of a general arrangement of an embodiment of a photomultiplier according to the present invention. FIGS. 2A and 2B are an assembly process diagram and a sectional view, respectively, for explaining a structure of a sealed container in the photomultiplier according to the present invention.

As shown in FIG. 1, the photomultiplier according to the present invention has a sealed container 100, with a pipe 600, which is used to depressurize the interior to a predetermined degree of vacuum (and the interior of which is filled after vacuum drawing), provided at a bottom portion, and has a photocathode 200 and an electron multiplier section 500 provided inside the sealed container 100.

As shown in FIG. 2A, the sealed container 100 is constituted by a faceplate 110, a tube body (bulb) 120 having the faceplate 110 that is fusion-joined to one end and that extends along a predetermined tube axis AX, and a stem 130 that is fusion-joined to the other end of the tube body 120 and that constitutes a bottom portion of the sealed container 100 provided with the pipe 600. FIG. 2B is a cross sectional view of the sealed container 100 taken on line I-I of FIG. 2A and shows, in particular, a portion at which the faceplate 110 is fusion-joined to the one end of the tube body 120. The faceplate 110 has a light incidence surface 110*a* and a light emission surface 110*b* that opposes the light incidence surface 110*a*, and the photocathode 200 is formed on the light emission surface 110*b* positioned at the inner side of the sealed container 100. The tube body 120 is a hollow member that is centered about the tube axis AX and extends along the tube axis AX. The faceplate 110 is fusion-joined to one end of this hollow member and the stem 130 is fusion-joined to the other end. The stem 130 is provided with a penetrating hole that extends along the tube axis AX and puts the interior of the sealed container 100 in communication with the exterior. Lead pins 700 are arranged so as to surround this penetrating hole. At the position at which the penetrating hole is provided, the pipe 600, for evacuating the air inside the sealed container 100, is attached to the stem 130.

An installation position of the electron multiplier section 500 in the tube axis AX direction inside the sealed container 100 is defined by the lead pins 700 that extend into the sealed container 100 from the stem 130. The electron multiplier section 500 also comprises a focusing electrode unit 300 for modifying trajectories of photoelectrons emitted into the sealed container 100 from the photocathode 200, and a dynode unit 400 for cascade multiplication of the photoelectrons.

In the following explanation, a multichannel photomultiplier, with which four electron multiplier channels CH1 to CH4 are constituted by two sets of electrodes (dynodes) arranged so as to sandwich the tube axis AX, shall be explained as an embodiment of the photomultiplier according to the present invention.

Figure 3:
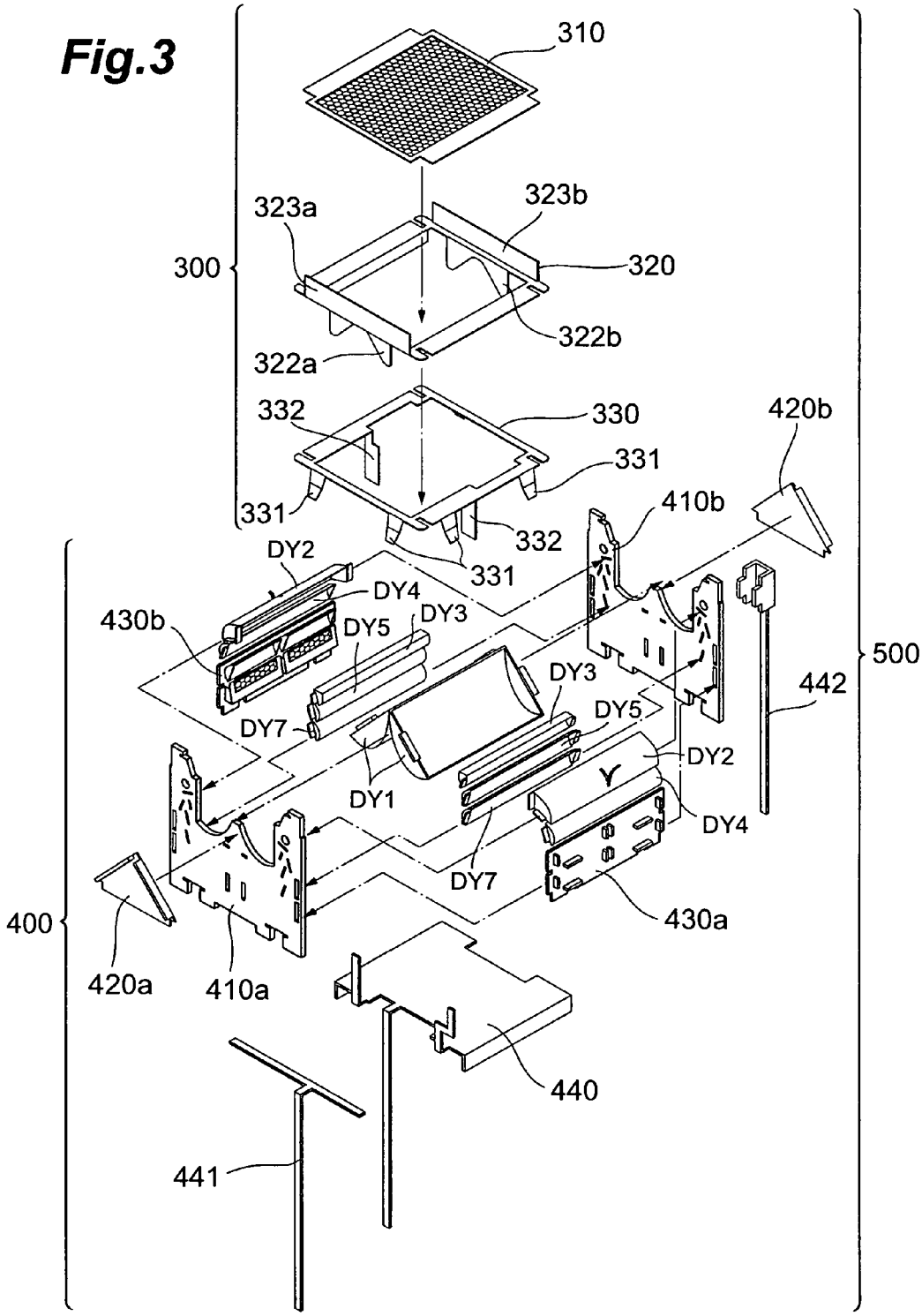
FIG. 3 is an assembly process diagram for explaining a structure of an electron multiplier section in the photomultiplier according to the present invention.

FIG. 3 is an assembly process diagram for explaining a structure of the electron multiplier section 500 in the photomultiplier according to the present invention. In FIG. 3, the electron multiplier section 500 has the focusing electrode unit 300 and the dynode unit 400.

The focusing electrode unit 300 is constituted by laminating a mesh electrode 310, a shield member 320, and a spring electrode 330. The mesh electrode 310 has a metal frame which is provided with an opening that allows photoelectrons from the photocathode 200 to pass through. The opening defined by the frame portion of the mesh electrode 310 is covered by a metal mesh that is provided with a plurality of openings. The shield member 320 has a metal frame provided with the opening that allows photoelectrons from the photocathode 200 to pass through. The frame portion that defines the opening of the shield member 320 is provided with shield plates 323*a*, 323*b* that extend toward the photocathode 200 and with shield plates 322*a*, 322*b* that extend toward the stem 130. The shield plates 323*a*, 323*b* respectively enable control of positions of incidence of photoelectrons onto first dynodes DY1 and function to adjust an electric field lens formed between the photocathode 200 and the focusing electrode unit 300 to improve the CTTD (that is, the TTS) response properties. The shield plates 322*a*, 322*b* are respectively positioned so as to close a space that is open at opposite ends of the first dynodes DY1. The shield plates 322*a*, 322*b* are set to a potential that is higher than that of the first dynodes DY1 (and equal to that of second dynodes DY2) and function to strengthen the electric field between the first dynodes DY1 and the second dynodes DY2. The efficiency of incidence onto the second dynodes DY2 of secondary electrons that propagate from the first dynodes DY1 to the second dynodes DY2 can thereby be improved, and the spread of transit times of secondary electrons between the first dynodes DY1 and the second dynodes DY2 is reduced. The spring electrode 330 has a metal frame provided with an opening that allows photoelectrons from the photocathode 200 to pass through. The frame portion of the spring electrode 330 is provided with metal springs 331 (electrode portions), which, by being pressed against an inner wall of the sealed container 100, maintain the entirety of the electron multiplier section 500, on which the focusing electrode unit 300 is mounted, at a predetermined position inside the sealed container 100. The frame portion of the spring electrode 330 is also provided with partitioning plates 332 that partition the second dynodes DY2, positioned immediately below, into two in a longitudinal direction of the second dynodes DY2. The partitioning plates 332 are set to the same potential as the second dynodes DY2 and function to effectively reduce the crosstalk between mutually adjacent electron multiplier channels that are formed from an electrode set of one series.

On the other hand, the dynode unit 400 has a pair of insulating supporting members (a first insulating supporting member 410*a* and a second insulating supporting member 410*b*) that hold the focusing electrode unit 300 of the above-described structure and clampingly hold at least two electrode sets that cascade-multiply the photoelectrons from the photocathode 200. Specifically, the first and second insulating supporting members 410*a*, 410*b* integrally clamp the pair of first dynodes DY1, the pair of second dynodes DY2, a pair of third dynodes DY3, a pair of fourth dynodes DY4, a pair of fifth dynodes DY5, a pair of seventh dynodes DY7, and a pair of gain control units 430*a*, 430*b*, with the dynodes or units of each pair being disposed along the tube axis AX and across the tube axis AX with respect to each other. Metal pins 441, 442 for setting the respective electrodes at predetermined potentials are mounted onto the first and second insulating supporting members 410*a*, 410*b*. The first and second insulating supporting members 410*a*, 410*b* clampingly hold, in addition to the respective electrodes, a bottom metal plate 440 that is set to a ground potential (0V).

In a state of being installed at upper portions of the first and second insulating supporting members 410*a*, 410*b*, the pair of first dynodes DY1 have metal fixing members 420*a*, 420*b* welded to both ends. Each of the pair of gain control units 430*a*, 430*b* has an insulating base plate 431 and onto this insulating base plate 431 are mounted a corresponding sixth dynode DY6, anode 432, and eighth dynode DY8. Here, each sixth dynode DY6 is constituted by two electrodes that are mounted on the insulating base plate 431 in an electrically separated state. Each anode 432 is constituted by two electrodes that are mounted on the insulating base plate 431 in an electrically separated state. Each eighth dynode DY8 is a common electrode for the two electrodes that constitute the sixth dynode DY6 and the two electrodes that constitute the anode 432.

As described above, each of the gain control units 430*a*, 430*b* belongs to one of the two electrode sets arranged so as to sandwich the tube axis AX. Thus, by these gain control units 430*a*, 430*b* being arranged together with the partitioning plates 332, the four-channel photomultiplier, with which two electron multiplier channels are formed by each electrode set, is arranged. The sixth dynode DY6 in each of the gain control units 430*a*, 430*b* is also constituted by two electrodes, and thus, for the photomultiplier as a whole, four electrodes are allocated as the sixth dynodes DY6 respectively to the electron multiplier channels. By individually adjusting the potentials of the electrodes allocated as the sixth dynodes DY6 to the respective electron multiplier channels, each electron multiplier channel can be adjusted in gain independent of the others.

Figure 4:
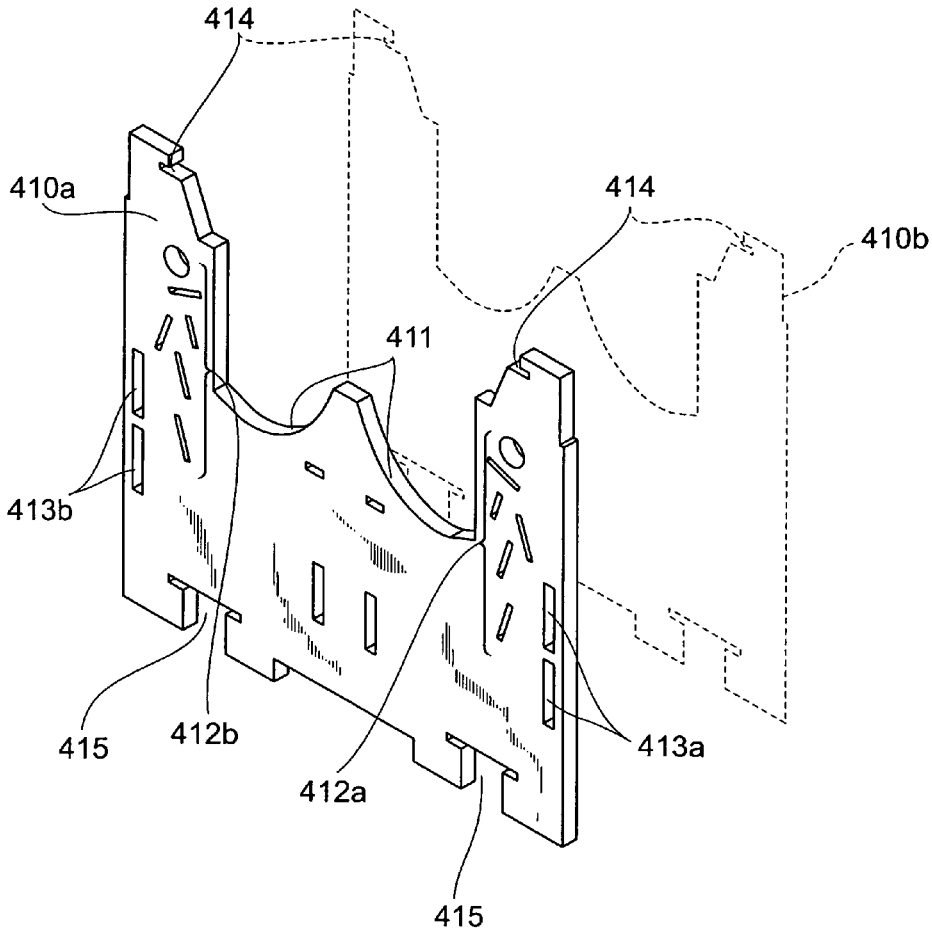
FIG. 4 is a diagram for explaining a structure of a pair of insulating supporting members that constitute a portion of the electron multiplier section shown in FIG. 3.

FIG. 4 is a diagram for explaining a structure of the pair of insulating supporting members 410*a*, 410*b* that constitute a portion of the electron multiplier section shown in FIG. 3. Because the first insulating supporting member 410*a* and the second insulating supporting member 410*b* are identical in shape, just the first insulating supporting member 410*a* will be explained below and explanation of the second insulating supporting member 410*b* will be omitted.

The first insulating supporting member 410*a* comprises: a main body that holds the first electrode set of the first to fifth dynodes DY1 to DY5, the seventh dynode DY7 and the gain control unit 430*a*, and the second electrode set of the first to fifth dynodes DY1 to DY5, the seventh dynode DY7 and the gain control unit 430*b*; and protruding portions that extend from the main body toward the photocathode 200.

The main body of the first insulating supporting member 410*a* is provided with fixing slits 412*a*, 413*a* for fixing the first electrode set, and fixing slits 412*b*, 413*b* for fixing the second electrode set (the same fixing slits are provided in the main body of the second insulating supporting member 410*b* as well).

Figure 5A:
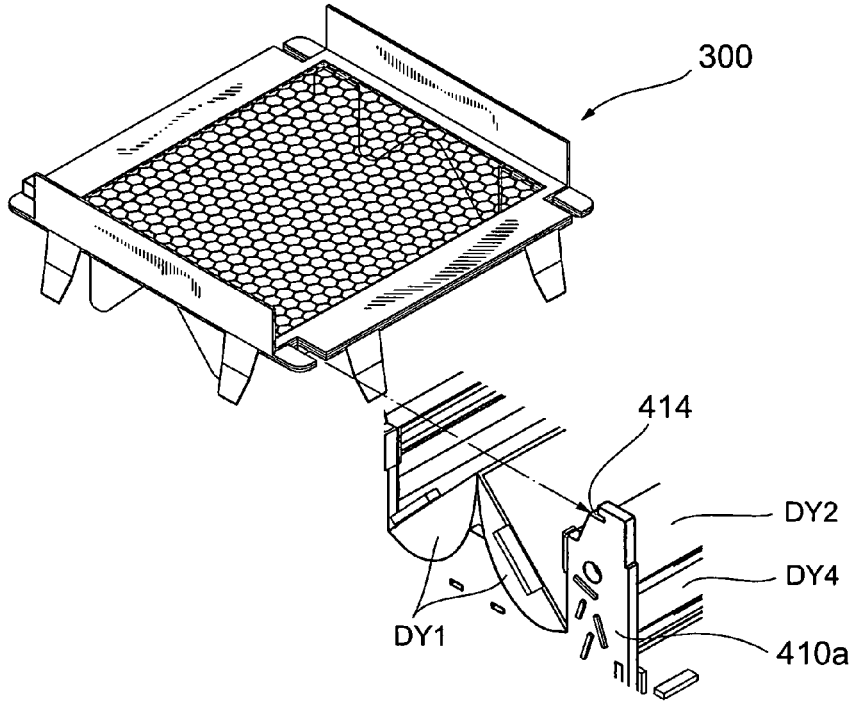
FIG. 5A is a diagram for explaining a structure that joins a focusing electrode unit and the pair of insulating supporting members.
Figure 5B:
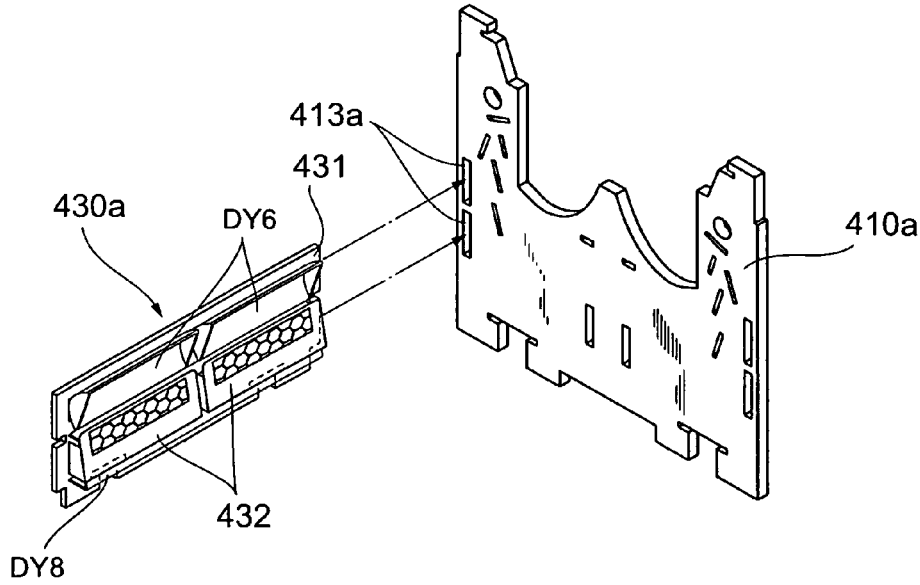
FIG. 5B is a diagram for explaining a structure that joins gain control units and the pair of insulating supporting members.

Of the first electrode set, one of fixing tabs provided at opposite ends of the second dynode DY2, one of fixing tabs provided at opposite ends of the third dynode DY3, one of fixing tabs provided at opposite ends of the fourth dynode DY4, one of fixing tabs provided at opposite ends of the fifth dynode DY5, and one of fixing tabs provided at opposite ends of the seventh dynode DY7 are inserted into the fixing slits 412*a* and these electrode members are thereby integrally clamped by the first and second insulating supporting members 410*a*, 410*b*. Also, as shown in FIG. 5B, fixing tabs of one end among fixing tabs provided at opposite ends of the gain control unit 430*a* belonging to the electrode set of the first series are inserted in the fixing slits 413*a*. Of the second electrode set, one of fixing tabs provided at opposite ends of the second dynode DY2, one of fixing tabs provided at opposite ends of the third dynode DY3, one of fixing tabs provided at opposite ends of the fourth dynode DY4, one of fixing tabs provided at opposite ends of the fifth dynode DY5, and one of fixing tabs provided at opposite ends of the seventh dynode DY7 are inserted into the fixing slits 412*b* and these electrode members are thereby integrally clamped by the first and second insulating supporting members 410*a*, 410*b*. Also, fixing tabs of one end among fixing tabs provided at opposite ends of the gain control unit 430*b* belonging to the electrode set of the second series are inserted in the fixing slits 413*b*.

Furthermore, notches 415 for clampingly holding a bottom metal plate 440 is provided at a bottom portion of the first insulating supporting member 410*a* (the same holds for the second insulating supporting member 410*b*). Also, pedestal portions 411, on which the first dynodes DY1 are mounted, are formed at portions sandwiched by the protruding portions of the first insulating supporting member 410*a*, and a notch 414 for holding the focusing electrode unit 300 is formed in each of the protruding portions (the same holds for the second insulating supporting member 410*b*). Specifically, as shown in FIG. 5A, notches formed in the focusing electrode unit 300 are inserted in the notches 414 respectively provided in the protruding portions of the first insulating supporting member 410*a*, and the focusing electrode unit 300 is thereby clampingly held integrally by the first and second insulating supporting members 410*a*, 410*b*. FIG. 5A is a diagram for explaining the structure that joins the focusing electrode unit 300 and the pair of insulating supporting members 410*a*, 410*b*, and FIG. 5B is a diagram for explaining the structure that joins the gain control units 430*a*, 430*b* and the pair of insulating supporting members 410*a*, 410*b*.

Figure 6:
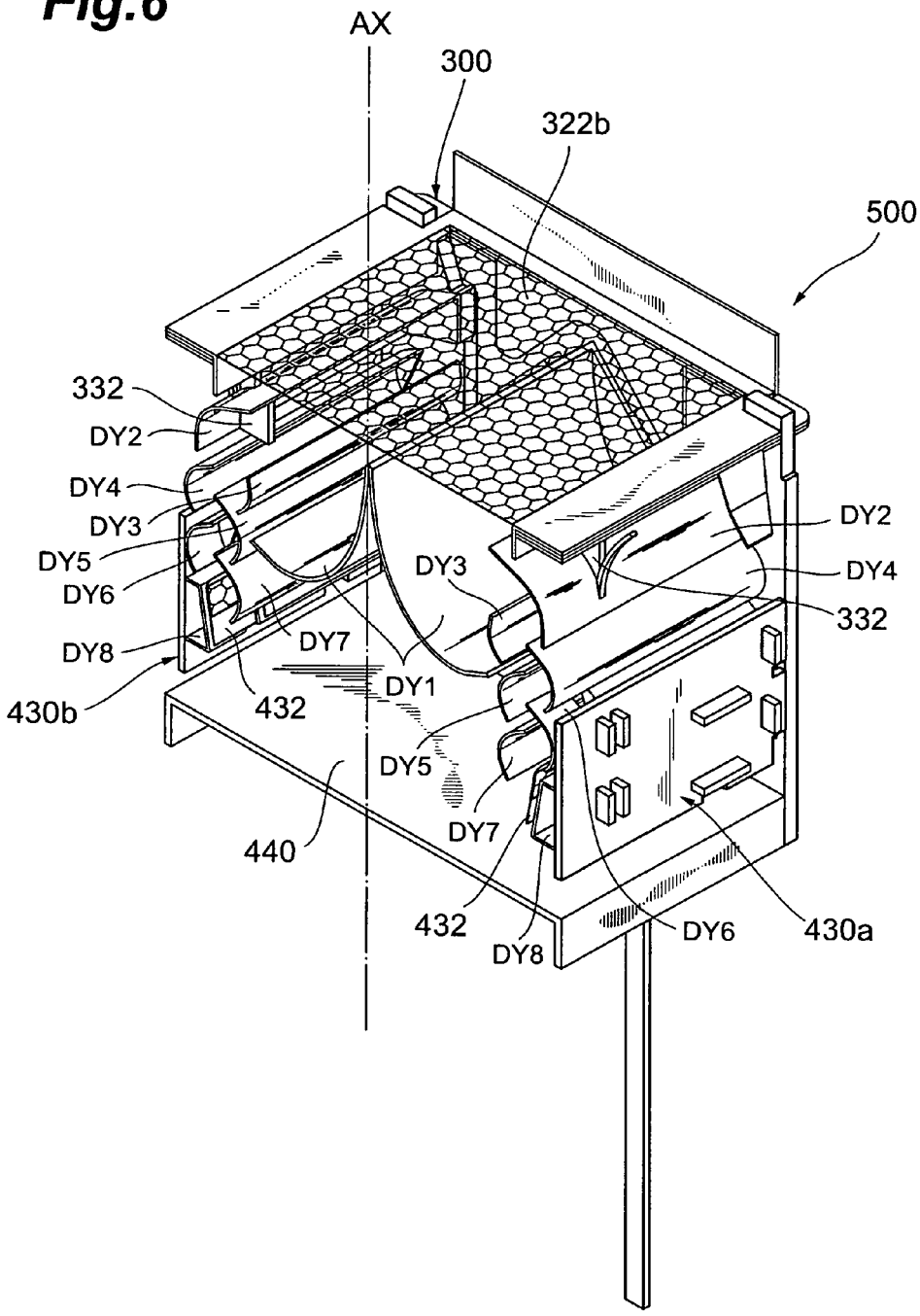
FIG. 6 is a perspective view for explaining a cross sectional structure of the electron multiplier section taken on line I-I shown in FIG. 1.

FIG. 6 is a perspective view for explaining a cross sectional structure of the electron multiplier section taken on line I-I shown in FIG. 1. As shown in FIG. 6, the electron multiplier section 500 has two electrode sets arranged so as to sandwich the tube axis AX. In each of these two electrode sets, mutually adjacent electron multiplier channels that can be adjusted in gain independently of each other are arranged by the corresponding partitioning plate 332, provided in the spring electrode 330 that constitutes a portion of the focusing electrode unit 300, and by the disposition of the corresponding gain control unit 430*a* or 430*b*. In the electron multiplier section 500 shown in FIG. 6, four electron multiplier channels are thus formed in correspondence to photoelectron emission positions of the photocathode 200.

In the one electrode set (first electrode set), among the two electrode sets arranged so as to sandwich the tube axis AX, to which the gain control unit 430*a* belongs, a secondary electron emitting surface is formed on each of the first dynode DY1 to the eighth dynode DY8. The set potential of each of the first dynode DY1 to the eighth dynode DY8 is increased in the order of the first dynode DY1 to the eighth dynode DY8 to guide the secondary electrons successively to the dynode of the next stage. The potential of the anode 432 is higher than the potential of the eighth dynode DY8. For example, the photocathode 200 is set to −1000V, the first dynode DY1 is set to −800V, the second dynode DY2 is set to −700V, the third dynode DY3 is set to −600V, the fourth dynode DY4 is set to −500V, the fifth dynode DY5 is set to −400V, the sixth dynode DY6 is set to −300V (made variable to enable gain adjustment), the seventh dynode DY7 is set to −200V, the eighth dynode DY8 is set to −100V, and the anode 432 is set to the ground potential (0V). The focusing electrode unit 300, with the partitioning plates 332, is set to the same potential as the second dynodes DY2.

The photoelectrons emitted from the photocathode 200 arrive at the first dynode DY1 after passing through the mesh openings of the focusing electrode unit 300 that is set to the same potential as the second dynode DY2. The shield plate 322*b*, set to the same potential as the second dynode DY2, is disposed at a space that is opened in the longitudinal direction of the first dynode DY1, and by this, the electric field between the first dynode DY1 and the second dynode DY2 is strengthened, the efficiency of incidence onto the second dynode DY2 of the secondary electrons, propagating from the first dynode DY1 to the second dynode DY2, can be improved, and the spread of transit times of the secondary electrons between the first dynode DY1 and the second dynode DY2 is reduced. The secondary electron emitting surface is formed on an electron arrival surface of the first dynode DY1, and in response to the incidence of photoelectrons, secondary electrons are emitted from the first dynode DY1. The secondary electrons emitted from the first dynode DY1 propagate toward the second dynode DY2, which is set to a higher potential than the first dynode DY1. The second dynode DY2 is separated into two electron multiplier channels by the partitioning plate 332 that extends from the focusing electrode unit 300, and a structure is realized with which, crosstalk between the adjacent electron multiplier channels is suppressed by adjustment of the trajectories of the secondary electrons from the first dynode DY1. The secondary electron emitting surface is also formed on an electron arrival surface of the second dynode DY2, and the secondary electrons emitted from the secondary electron emitting surface of the second dynode DY2 propagate toward the third dynode DY3, which is set to a higher potential than the second dynode DY2. The secondary electrons emitted from the secondary electron emitting surface of the third dynode DY3 are likewise cascade-multiplied as the electrons proceed in the order of the fourth dynode DY4, the fifth dynode DY5, and the sixth dynode DY6. The sixth dynode DY6 is constituted by the two electrodes that constitute portions of the gain control unit 430*a* and by suitable adjustment of the set potentials of these two electrodes, the gains of the adjacent electron multiplier channels can be adjusted independent of each other. The secondary electrons emitted from the secondary electron emitting surfaces of the respective electrodes constituting the sixth dynode DY6 arrive at the seventh dynode DY7, and secondary electrons are emitted from the secondary electron emitting surface of the seventh dynode DY7 toward the anode 432 with mesh openings. The eighth dynode DY8 is set to a lower potential than the anode 432 and functions as an inverting dynode that emits secondary electrons, which have passed through the anode 432, back to the anode 432. The other electrode set, to which the gain control unit 430*b* belongs, also functions in the same manner.

Figure 7A:
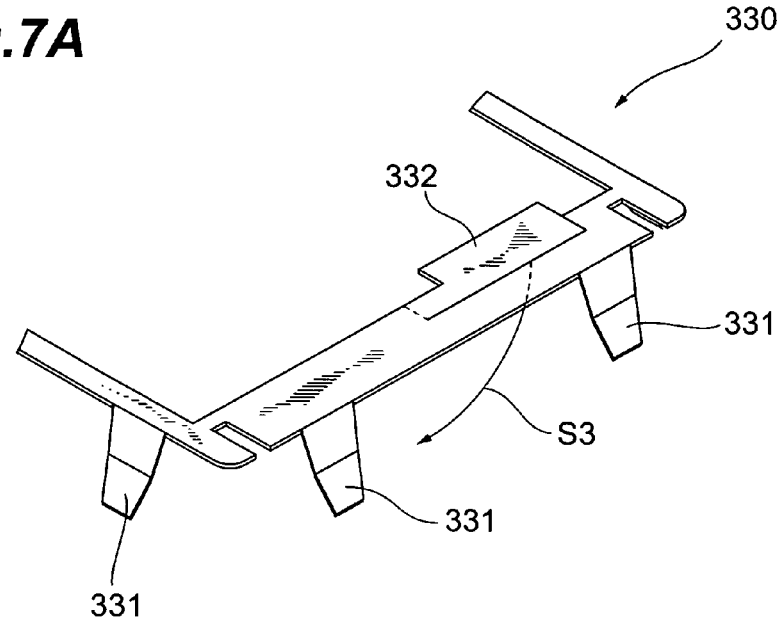
FIGS. 7A and 7B are cross sectional views for explaining a structural feature of the photomultiplier according to the present invention.
Figure 7B:
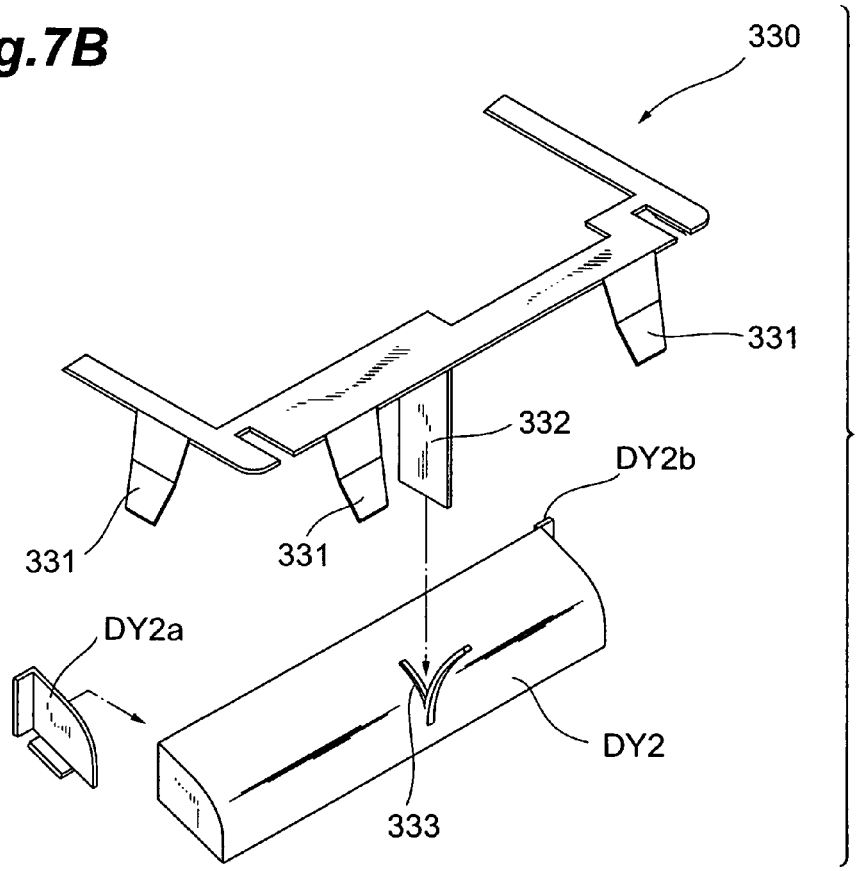

Next, the structural feature of the photomultiplier according to the present invention will be explained using FIGS. 7A to 9C. As the structural feature, the photomultiplier is provided with the partitioning plates 332 that partition the associated second dynode DY2 in two in the longitudinal direction of the associated second dynode DY2. FIGS. 7A and 7B are perspective views for explaining the structural feature of the photomultiplier according to the present invention, and in the present embodiment, the partitioning plates 332 are provided on the focusing electrode unit 300 positioned above the second dynodes DY2. By this arrangement, the partitioning plates 332 are set to the same potential as the associated second dynodes DY2. Additionally, in the present embodiment, the partitioning plates 332 are provided for every electrode set, and, by two electrode sets arranged so as to sandwich the tube axis AX and the partitioning plates 332 each prepared for the respective electrode sets, four electron multiplier channels are constituted.

Specifically, the partitioning plates 332 are provided on the spring electrode 330 that constitutes a part of the focusing electrode unit 300. As shown in FIG. 7A, the spring electrode 330 has the metal frame that is provided with the opening that allows photoelectrons from the photocathode 200 to pass through. The frame portion of the spring electrode 330 is provided with the metal springs 331 (electrode portions), which, by being pressed against an inner wall of the sealed container 100, maintain the entirety of the electron multiplier section 500 at a predetermined position inside the sealed container 100 and also serve to make the photocathode 200 and the focusing electrode unit 300 equal in potential. The frame portion of the spring electrode 330 is also provided with partitioning plates 332, each of which, by being bent in the direction indicated by arrow S3 in FIG. 7A, partitions the associated second dynodes DY2, positioned immediately below, into two in the longitudinal direction of the associated second dynodes DY2. Each second dynode DY2, having the fixing tabs DY2*a*, DY2*b* fixed by welding to the opposite ends thereof, is provided with a slit 333 for insertion of the partitioning plate 332, and when the focusing electrode unit 300 is mounted onto the pair of insulating supporting members 410*a*, 410*b*, each of the partitioning plates 322 is inserted into the associated second dynode DY2 via the slit 333 at the same time. By this arrangement, the crosstalk between mutually adjacent electron multiplier channels that are formed from an electrode set of one series is reduced effectively.

Figure 8A:
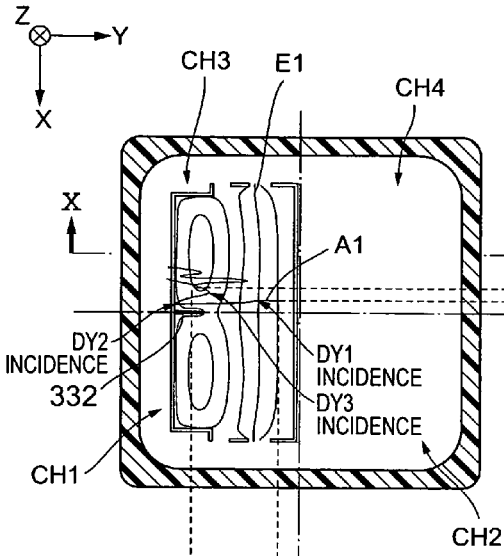
FIGS. 8A to 8C are cross sectional perspective views for explaining effects of the structural feature of the photomultiplier according to the present invention.
Figure 8B:
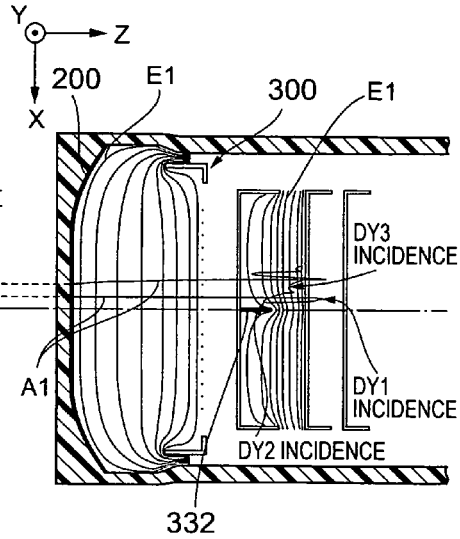
Figure 8C:
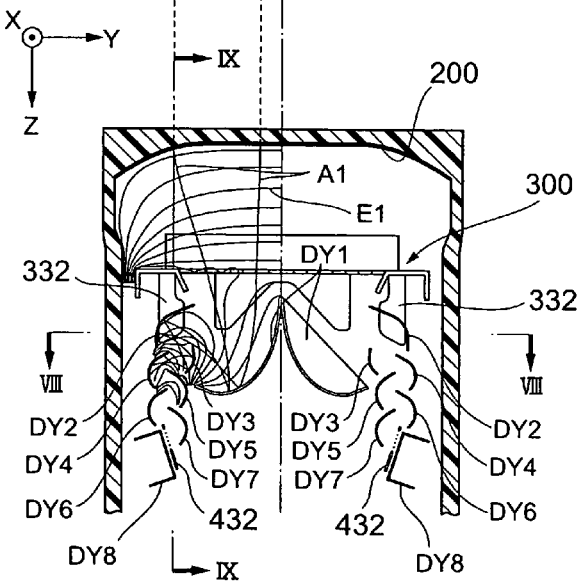
Figure 9A:
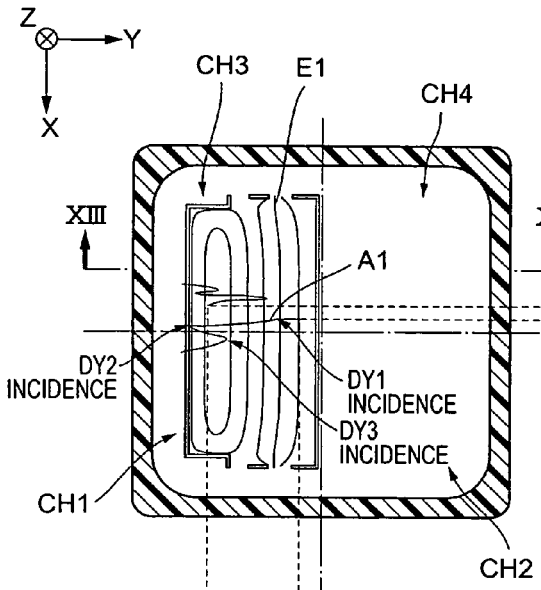
FIGS. 9A to 9C are perspective views for explaining electron trajectories in a photomultiplier (not having the structural feature) according to a comparative example prepared for explaining the effects of the structural feature of the photomultiplier according to the present invention.
Figure 9B:
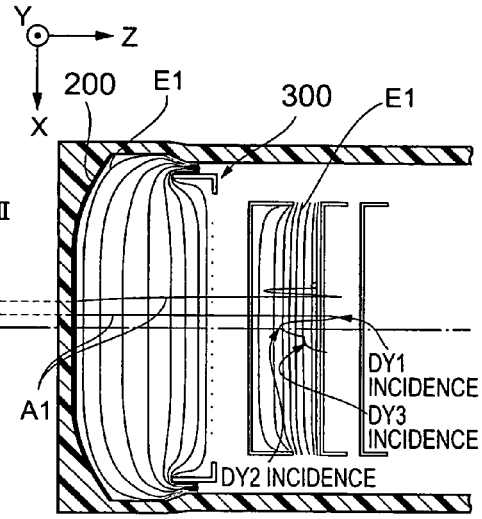
Figure 9C:
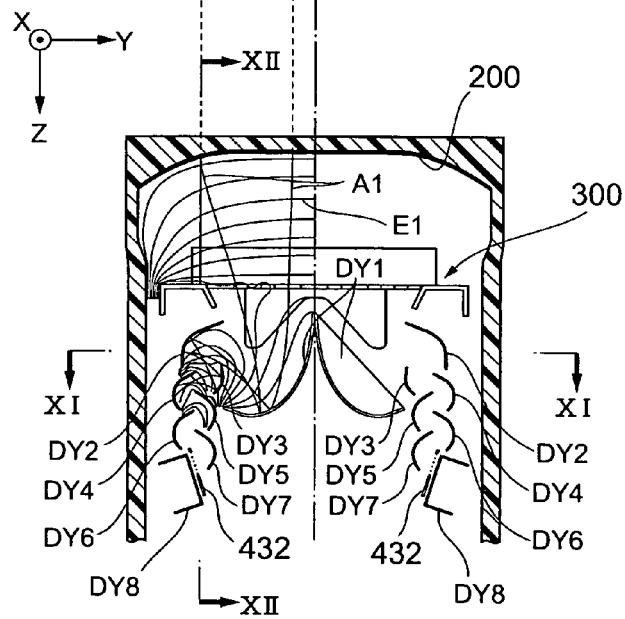

FIGS. 8A to 8C are cross sectional views for explaining effects of the structural feature (the partitioning plates 332) of the photomultiplier according to the present invention. FIGS. 9A to 9C are cross sectional views for explaining electron trajectories in a photomultiplier (with a structure without partitioning plates) according to a comparative example prepared for explaining the effects of the structural feature of the photomultiplier according to the present invention. In each of FIGS. 8A to 9C, A1 shows a trajectory of photoelectron and E1 shows an equipotential. Furthermore, in each of FIGS. 8A to 9C, CH1 to CH4 respectively show first to fourth electron multiplier channels.

FIG. 8A is a cross sectional view taken on line VIII-VIII shown in FIG. 8C of a cross sectional structure of the photomultiplier provided with the partitioning plates 332 as the structural feature. Oppositely, FIG. 8C is a cross sectional view of the photomultiplier (having the structural feature) taken on line X-X shown in FIG. 8A. FIG. 8B is a cross sectional view of the photomultiplier taken on line IX-IX shown in FIG. 8C. As can be understood from FIGS. 8A to 8C, the trajectories of electrons that arrive at the first dynodes DY1 from the photocathode 200 and propagate further in the order of the second dynodes DY2 and the third dynodes DY3 are significantly improved in regard to the possibility of crossing across to adjacent electron multiplier channels due to the second dynodes DY2 being partitioned by the partitioning plates 332 that are set to a lower potential than the second dynodes DY2 (the crosstalk between adjacent electron multiplier channels is reduced significantly).

On the other hand, in the photomultiplier according to the comparative example that does not have the structural feature (partitioning plates), crosstalk occurs between the adjacent electron multiplier channels as shown in FIGS. 9A to 9C. The trajectories of electrons that arrive at the first dynodes DY1 from the photocathode 200 and propagate further in the order of the second dynodes DY2 and the third dynodes DY3 cross across adjacent electron multiplier channels in the middle of transit from the second dynodes DY2 to the third dynodes DY3. Thus, in accordance with the photomultiplier according to the comparative example that is not provided with partitioning plates, the crosstalk between adjacent electron multiplier channels cannot be reduced effectively. FIG. 9A is a cross sectional view taken on line XI-XI shown in FIG. 9C of a cross sectional structure of the photomultiplier according to the comparative example (without partitioning plates). Oppositely, FIG. 9C is a cross sectional view of the photomultiplier according to the comparative example taken on line XIII-XIII shown in FIG. 9A. FIG. 9B is a cross sectional view of the photomultiplier according to the comparative example taken on line XII-XII shown in FIG. 9C.

As shown in FIG. 2B, in the photomultiplier according to the present invention, the light emission surface 110*b* of the faceplate 110 is constituted by the flat region and the curved-surface processed region, positioned at the periphery of the flat region and including the edges of the light emission surface 110*b*. The surface shape of the peripheral region of the light emission surface 110*b* of the faceplate 110 is thus intentionally changed in order to adjust the angles of emission of photoelectrons from the photocathode 200 positioned at the peripheral region. The spread of transit times of photoelectrons propagating from the photocathode 200 to the first dynode DY1 is thus reduced effectively and is made not to depend on the emission positions of the photoelectrons.

Also, the first dynodes DY1, respectively belonging to the two electrode sets, are arranged back-to-back with respect to each other while sandwiching the tube axis AX as shown in FIG. 6. In this case, the collection efficiency of the photoelectrons that arrive at the periphery of the first dynodes DY1 is improved significantly. For example, because an electrode for guiding photoelectrons from the photocathode 200 to the first dynodes DY1 is not required between the photocathode 200 and the first dynodes DY1, a stronger electric field strength in comparison to the conventional art can be obtained at a peripheral region of the photocathode 200 and the intervals of the equipotential lines are also made uniform. Photoelectrons emitted from a peripheral region of the photocathode 200 thus do not arrive directly at the second dynodes DY2 without arriving at the first dynodes DY1.

Furthermore, the width in the longitudinal direction of the first dynode DY1 is preferably set greater than the interval between the pair of insulating supporting members 430*a*, 430*b*. In this case, the effective surface of arrival of photoelectrons from the photocathode 200 is expanded. Also, as the shield structure at the periphery of the first dynodes DY1, the shield plates 322*a*, 322*b* are arranged at positions at which the plates close the space that is open at opposite ends of the first dynodes DY1 as shown in FIGS. 3 and 6. The shield plates 322*a*, 322*b* are set to a higher potential (equal to the potential of the second dynodes DY2) than the first dynodes DY1 and function to strengthen the electric field between the first and second dynodes DY1, DY2. The efficiency of incidence onto the second dynodes DY2 of the secondary electrons propagating from the first dynodes DY1 to the second dynodes DY2 can thereby be improved, and the spread of transit times of secondary electrons between the first and second dynodes DY1, DY2 is reduced.

As described above, in accordance with the photomultiplier according to the present invention, the crosstalk between electron multiplier channels constituting one electrode set can be effectively reduced, and whereby the TTS, CTTD, and other response time properties are improved significantly. Also, by the gain control unit, with which a portion of the dynodes and the anode are integrated, the number of parts in the assembly process can be reduced and a plurality of electron multiplier channels can be arranged with a simpler structure.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier comprising:

a sealed container including a hollow body section extending along a predetermined tube axis and a faceplate provided so as to intersect the tube axis said faceplate transmitting light with a predetermined wavelength;

a photocathode provided inside said sealed container so as to emit photoelectrons into said sealed container in response to incidence of the light with the predetermined wavelength;

a dynode unit provided inside said sealed container so as to cascade-multiply photoelectrons emitted from said photocathode said dynode unit including at least one dynode set being constituted by a plurality of dynodes that respectively have a single secondary electron emitting surface, said one dynode set including, at least, a first dynode emitting secondary electrons in response to incidence of photoelectrons, and a second dynode receiving secondary electrons from said first dynode and arranged such that the single secondary electron emitting surface of said second dynode faces that of said first dynode; and a partitioning plate comprised of a conductive material and partitioning the single secondary electron emitting surface of said second dynode into two in a longitudinal direction of said second dynode said partitioning plate extending in a direction directed from said photocathode to said dynode unit such that a tip thereof is positioned in a space between the single secondary electron emitting surfaces of said first and second dynodes; and a focusing electrode unit arranged between said photocathode and said dynode unit, wherein said partitioning plate includes a metal tab of said focusing electrode unit that extends in a direction directed from said photocathode to said dynode unit, wherein said second dynode has a slit that puts a front surface, on which its single secondary electron emitting surface is formed, in communication with a back surface that opposes the front surface, and wherein said metal tab of said focusing electrode unit extends in the direction directed from said photocathode to said dynode unit such that the tip thereof is positioned, via said slit of said second dynode, in the space between the single secondary electron emitting surfaces of said first and second dynodes.

2. A photomultiplier comprising:

a sealed container including a hollow body section extending along a predetermined tube axis, and a faceplate provided so as to intersect the tube axis, said faceplate transmitting light with a predetermined wavelength;

a photocathode provided inside said sealed container so as to emit photoelectrons into said sealed container in response to incidence of the light with the predetermined wavelength;

a dynode unit provided inside said sealed container so as to cascade-multiply photoelectrons emitted from said photocathode, said dynode unit including at least one dynode set being constituted by a plurality of dynodes that respectively have a single secondary electron emitting surface, said one dynode set including, at least, a first dynode emitting secondary electrons in response to incidence of photoelectrons, and a second dynode receiving secondary electrons from said first dynode and arranged such that the single secondary electron emitting surface of said second dynode faces that of said first dynode; and a partitioning plate comprised of a conductive material and partitioning the single secondary electron emitting surface of said second dynode into two in a longitudinal direction of said second dynode, said partitioning plate extending in a direction directed from said photocathode to said dynode unit such that a tip thereof is positioned in a space between the single secondary electron emitting surfaces of said first and second dynodes, wherein said one dynode set further includes a third dynode positioned in the space between the single secondary electron emitting surfaces of said first and second dynodes, said third dynode arranged such that the single secondary electron emitting surface of said third dynode faces that of said second dynode, and wherein the tip of said partitioning plate is positioned between the single secondary electron emitting surfaces of said second and third dynodes.

* * * * *